US008177228B2

(12) United States Patent
Nützel et al.

(10) Patent No.: US 8,177,228 B2
(45) Date of Patent: May 15, 2012

(54) METHOD AND APPARATUS FOR MONITORING THE SINGLING OF SHEET MATERIAL

(75) Inventors: Dominik Nützel, Munich (DE); Frantz Reuter, Dorfen (DE); Rainer Stoll, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 143 days.

(21) Appl. No.: 12/334,258

(22) Filed: Dec. 12, 2008

(65) Prior Publication Data

US 2009/0152800 A1 Jun. 18, 2009

Related U.S. Application Data

(60) Provisional application No. 61/091,884, filed on Aug. 26, 2008.

(30) Foreign Application Priority Data

Dec. 13, 2007 (DE) ..... 10 2007 060 080

(51) Int. Cl.
*B65H 7/12* (2006.01)
*B65H 7/08* (2006.01)

(52) U.S. Cl. ..... 271/262; 271/261; 271/265.04; 271/265.03; 271/228; 271/227

(58) Field of Classification Search ..... 271/262, 271/265.04, 261, 265.03, 227, 228
See application file for complete search history.

(56) References Cited

U.S. PATENT DOCUMENTS 3,310,304 A * 3/1967 Foias et al. ..... 101/234
4,160,546 A 7/1979 McMillan et al.
5,384,631 A * 1/1995 Matsunami ..... 399/370
5,527,031 A 6/1996 Walsh et al.
5,662,321 A 9/1997 Borostyan et al.
6,283,471 B1 * 9/2001 Kunzel et al. ..... 271/227
6,588,740 B2 * 7/2003 Brugger et al. ..... 271/10.03
7,690,650 B2 * 4/2010 Itoh et al. ..... 271/263
2004/0100016 A1 5/2004 Lay et al.
2004/0119771 A1 6/2004 Hwang
2004/0211904 A1 10/2004 Scowen et al.
2006/0115138 A1 6/2006 Klock et al.
2007/0040319 A1 2/2007 Chang et al.
2007/0114716 A1 * 5/2007 Morikawa et al. ..... 271/258.01

FOREIGN PATENT DOCUMENTS

DE 103 18 756 A1 11/2004
EP 1 248 224 A2 10/2002
WO WO 98/04484 2/1998
WO 2004/080865 A1 9/2004

OTHER PUBLICATIONS

Search Report of German Patent Office relating to German Patent Application No. DE 10 2007 060 080.3, Aug. 27, 2008.
International Search Report issued in PCT/EP2008/010039, Mar. 23, 2009, 3 pages.

* cited by examiner

*Primary Examiner* — Michael McCullough
*Assistant Examiner* — Luis A Gonzalez
(74) *Attorney, Agent, or Firm* — Bacon & Thomas, PLLC

(57) ABSTRACT

The invention relates to an apparatus and a method for monitoring the singling of sheet material, in particular of bank notes.

Figure 1:
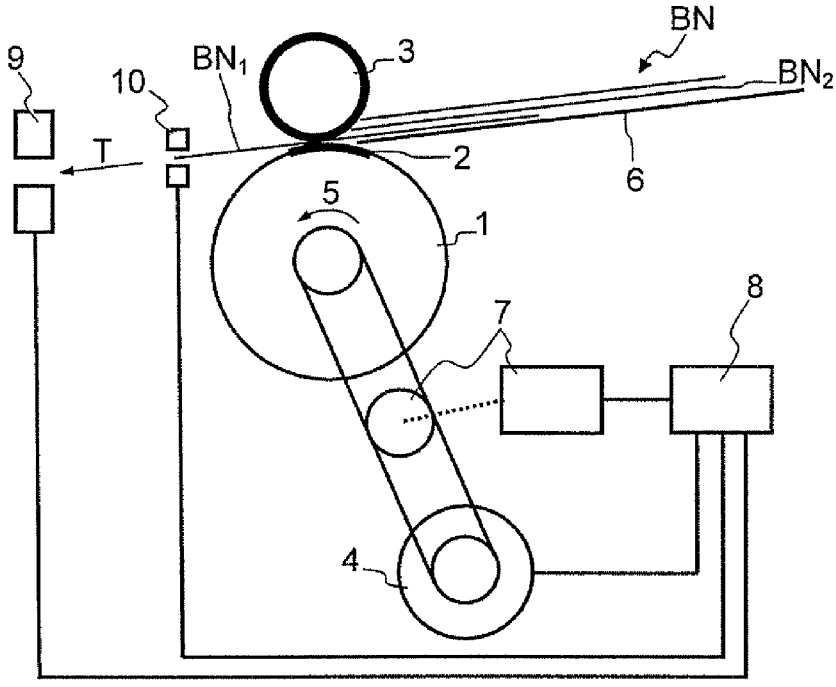

The invention starts out from monitoring the singling of sheet material, in particular of bank notes, by means of a singler having a drive and a control device for a monitoring and controlling of the singler, wherein a monitoring of place, time, orientation and state of the singled sheet material is effected immediately after the singling.

4 Claims, 3 Drawing Sheets

METHOD AND APPARATUS FOR MONITORING THE SINGLING OF SHEET MATERIAL

The benefit under 35 USC 119(e) of provisional application 61/091,884 filed Aug. 26, 2008 is claimed and the entirety of said application is incorporated herein by reference.

The invention relates to a method and an apparatus for monitoring the singling of sheet material, in particular of bank notes.

For processing sheet material, in particular bank notes, it is provided that the bank notes are inputted into an input area as loose stacks and are singled by a singler. The individual bank notes are transferred to a transport system by the singler and supplied to processing. Usual types of processing bank notes are the acceptance, check and recognition of bank notes by means of sensors, there being determined authenticity, type (currency, denomination), state (soiling, damage) etc. Based on the results of the check and recognition, the bank notes are subsequently e.g. sorted, stacked, bundled, destroyed etc.

For processing the bank notes in the bank note processing machines it is of elementary importance that after the singling by the singler the bank notes each are actually present in separated fashion. Therefore, in the past, a plurality of improvements has been proposed, which were to improve the quality of the singling and to ensure that the singler singles only one bank note at a time and, in particular, prevents the singling of two or more bank notes at the same time.

For this purpose, for example, elaborate mechanical improvements of the singler itself have been proposed. Likewise, it has been proposed to install a sensor immediately after the singler in order to determine whether the singler has grasped more than one bank note on singling.

Further problems occur during singling, when besides normal bank notes changed bank notes are present in the input area. The changes first of all are foldings of the bank notes. Such folded bank notes cause problems during the further processing, since they lead to jams in the transport system or cannot be recognized and checked by the sensors.

Additional problems on processing bank notes singled by the singler occur, when the singler does not evenly grasp the bank notes to be singled during the singling. In this case the bank notes are transferred in an oblique fashion to the transport system and can also lead to jams or problems, when the sensors carry out the recognition and check.

Starting out from the stated prior art and the problems connected therewith, the invention is based on the problem to provide a method and an apparatus for monitoring the singling of sheet material, in particular bank notes, by means of a singler, which without elaborate mechanical improvements of the singler itself clearly improves the quality of singling.

The solution to this problem appears from the features as described herein.

The invention starts out from monitoring the singling of sheet material, in particular of bank notes, by means of a singler having a drive and a control device for a monitoring and controlling of the singler, wherein a monitoring of place, time, orientation and state of the singled sheet material is effected immediately after the singling.

The advantage of the solution according to the invention is that by monitoring place, time, orientation and state of the singled sheet material immediately after the singling, it can be reliably recognized whether during the singling of sheet material with the singler according to the invention there occur errors, in particular whether double or multiple picks of sheet material are effected, or whether changed bank notes, e.g. folded bank notes, are grasped by the singler, or whether the sheet material is singled evenly and with good quality.

In a development it is provided that sensors disposed in two opposite edge areas of the width provided for the transport of sheet material are formed by light barriers, and that a sensor disposed in between is formed by an ultrasonic sensor.

The development has the advantage that an especially simple and cost-efficient structure for monitoring place, time, orientation and state of the singled sheet material is provided.

Further embodiments and advantages of the invention are explained in the following with reference to the Figures and their description.

Figure 2:
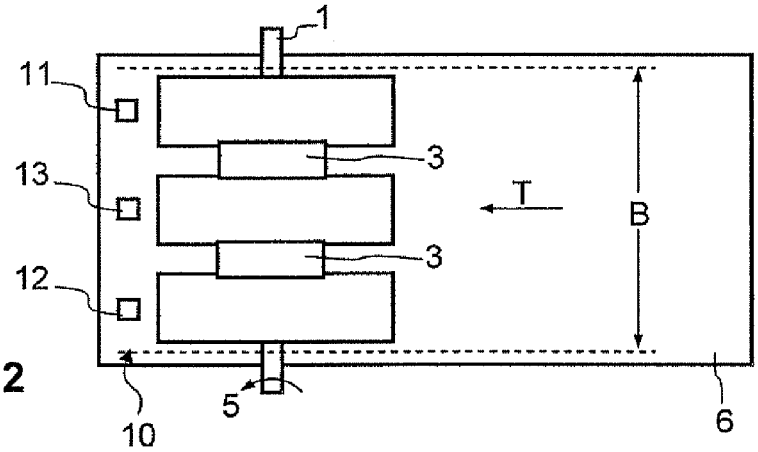
Figure 3:
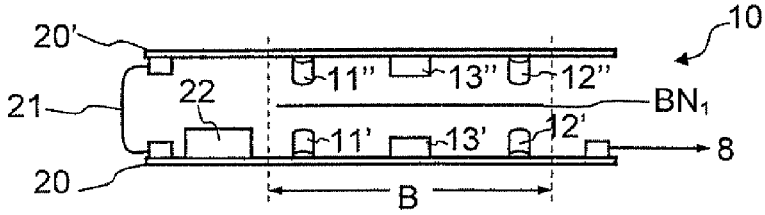

FIG. 1 shows a basic structure of a singler, for the singling of sheet material, in particular of bank notes, FIG. 2 shows a view onto areas located before and after the position of the singler effecting the singling according to FIG. 1, FIG. 3 shows a basic structure of sensors for monitoring the singler according to FIG. 1, and FIGS. 4 to 9 show the view according to FIG. 2, in different singling operations.

FIG. 1 shows a basic structure of a singler for the singling of sheet material, in particular bank notes.

Exemplary singler 1, 2, 3 has the structure of a so-called friction wheel singler, which has a singling element 1 with a friction element 2 and a retaining element 3. Singling element 1 is of a wheel-shaped or roller-shaped structure and has the friction element 2 within a certain part of its circumference. Compared to the remaining surface of singling element 1, friction element 2 has a higher coefficient of friction. In this way it is achieved that bank notes BN to be singled, which are inputted into an input area 6 for singling, are grasped and singled by the friction element 2 only when the singling element 1 is rotated by a drive 4, 7 in a predetermined first direction 5. Therefore, with a complete revolution of the singling element 1 only one bank note $BN_1$ is grasped and singled by the friction element 2.

Drive 4, 7 consists of a motor 4 and a velocity sensor 7, for example an optical rotary encoder. For setting a desired speed, the signals of the velocity sensor 7 are evaluated and the motor 4 is controlled by a control device 8.

To retain further bank notes BN, which are in the input area 6 together with the bank note $BN_1$ just grasped by the singling element 1 or its friction element 2, from being grasped and singled, retaining element 3 is provided. Retaining element 3 has an increased coefficient of friction over its entire circumference. By the choice of the coefficient of friction and/or by determining the geometric shape of retaining element 3 and singling element 1 with associated friction element 2, it is achieved that the rotation of singling element 1 results in ratios of forces, which permit the singling of one bank note $BN_1$ and the retention of further bank notes BN. Likewise, it is possible that the retaining element 3 is also driven. For this, however, a direction of rotation is chosen, which opposes the direction of rotation 5 of the singling element 1, in order to effect the retention of the further bank notes BN.

The structure of such a singling element 1 with associated friction element 2 and retaining element 3 is described e.g. in DE 102 24 486 A1. Retaining element 3 can also have a different, for example runner-shaped, form. It is obvious, that besides the friction wheel singler described by way of example, every other singler can be used for singling bank notes and their monitoring according to the invention.

After bank note $BN_1$ has been singled, it is transferred to a not shown transport system, which is part of a bank note processing machine likewise not shown, and the singled bank notes are transported in a transport direction T through the bank note processing machine for being further processed, where they are, for example, checked by further sensors 9 and are processed in the way described at the outset.

Sensors 10 are disposed immediately after singler 1, 2, 3, which check the bank note BN1 grasped and singled by singler 1, 2, 3 as to whether a faulty singling has occurred, i.e. whether in particular more than one bank note was singled, whether the singled bank note is a changed bank note, in particular whether the bank note is folded, and whether the bank note was singled by the singler 1, 2, 3 with good quality, in particular whether the bank note was transferred to the transport system in an oblique fashion. For this purpose control device 8 ascertains from the signals of sensors 10, at which place, at which time, in which state and in which orientation the bank note is recognized by sensors 10. Control device 8 links the information about place, time, state and orientation of the bank note and derives therefrom, whether a single, well singled bank note is present, or whether an error has occurred during the singling, or whether the bank note is faulty. Here the place means, at which position perpendicular to width B of the transport system, when viewed in transport direction T, the bank note is recognized by sensors 10. Time means, when the bank note is recognized by sensors 10. State means, whether sensors 10 recognize one or a plurality of bank notes, this also encompasses the recognition of folded bank notes. Orientation means, whether the bank note is transported past sensors 10 in parallel or obliquely in relation to its edges, when viewed in transport direction T.

As to be recognized from FIG. 2, sensors 10 are three sensors 11, 12, 13. Sensors 11 and 12 determine the presence or absence of bank notes and can have the form of light barriers. They are located in the area of the edges within the width B of the transport system, when viewed in transport direction T. Sensors 11 and 12 in particular determine place, time and orientation of the bank note. Sensor 13 in particular determines the state of the bank note, but also serves for determining place, time and orientation of the bank note. Sensor 13 can have the form of a thickness sensor, in particular an ultrasonic sensor, and is disposed between sensors 11 and 12, in particular centrally between sensors 11 and 12. Preferably, sensors 11, 12, 13 are disposed along a line, which extends perpendicular to transport direction T.

In FIG. 3 a structure of sensors 10 is shown. Sensors 10 are compactly built on two printed circuit boards 20, 20'. Transmitters 11' and 12' of light barriers 11 and 12, e.g. light emitting diodes, and a transmitter 13' of the ultrasonic sensor 13, e.g. a piezoelectric transducer, are located on one of the printed circuit boards 20. Receivers 11" and 12" of the light barriers 11 and 12, e.g. photodiodes, and a receiver 13" of the ultrasonic sensor 13, e.g. a piezoelectric transducer, are disposed opposingly on a second printed circuit board 20'. Printed circuit boards 20, 20' are electrically connected to each other 21, and an electronic drive and evaluation system 22, which e.g. is disposed on the first printed circuit board 20, actuates light barriers 11 and 12 and the ultrasonic sensor 13 and evaluates their signals. For further evaluating the signals of sensors 10, sensors 10 are connected with control device 8.

On the basis of FIGS. 4 to 9 in the following the mode of functioning of sensors 10 is explained. FIGS. 4 to 9 correspond to FIG. 2, in each case there being shown the state immediately after the singling of correct or faulty singlings of one or a plurality of bank notes. For improving the clarity, retaining element 3 is not shown.

In the following table there are stated the respective states immediately after the singling by the singler, i.e. how a bank note or a plurality of bank notes were grasped and singled by singler 1, 2, 3. In addition, it is stated, in which of the FIGS. 4 to 9 the respective singling state is shown. Furthermore, the table contains the respective signals generated by sensors 10, i.e. the signals of light barriers 11 and 12 (LS 11, LS 12) and of ultrasonic sensor 13 (US 13). In the column result can be found the conclusion from the singling carried out by the singler, i.e. whether the respective singling is correct or faulty, derived by control device 8 from the signals of sensors 10 with the help of the above-described logic operation.

Figure 4:
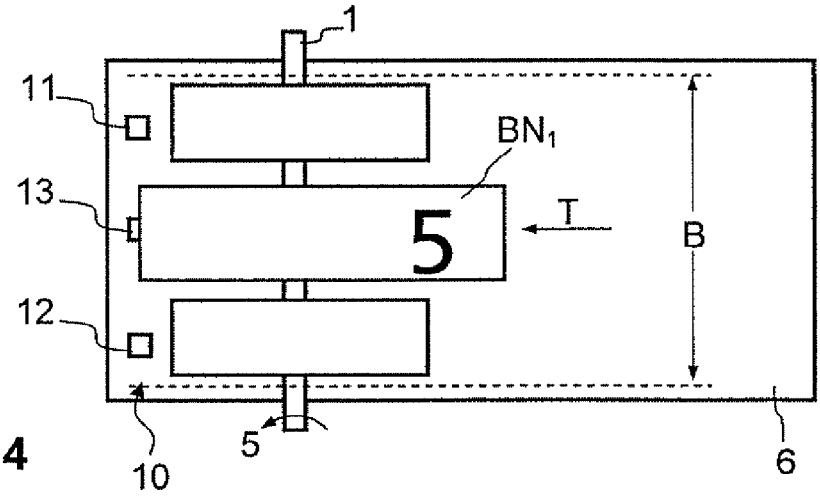
Figure 5:
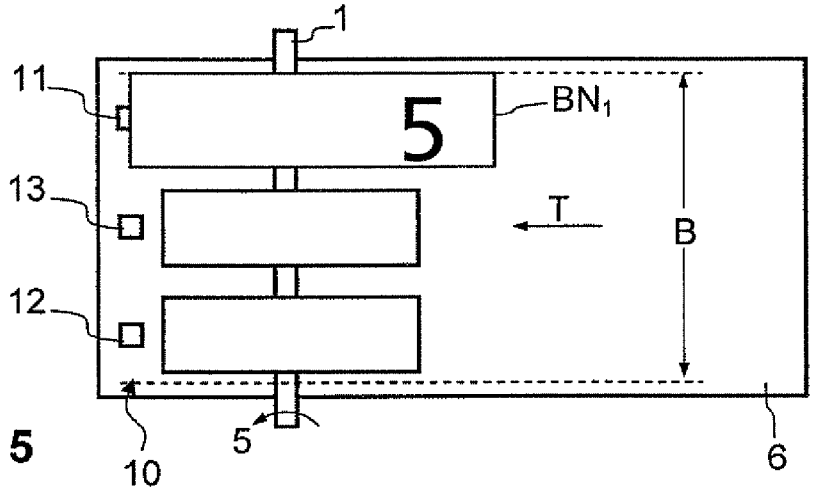
Figure 6:
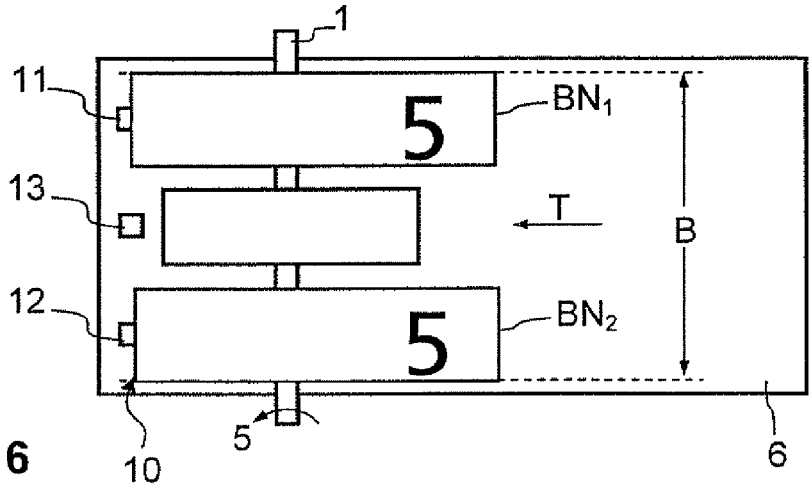
Figure 7:
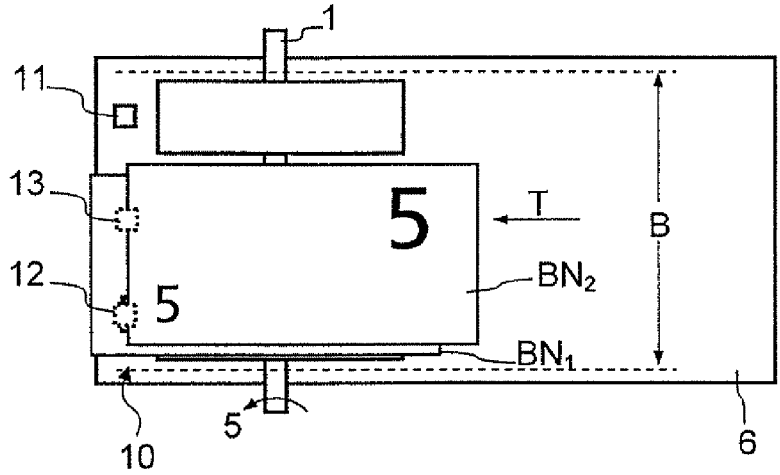
Figure 8:
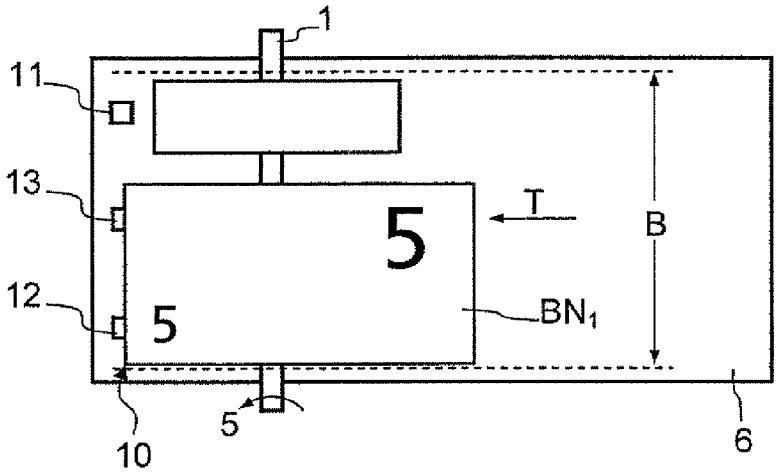
Figure 9:
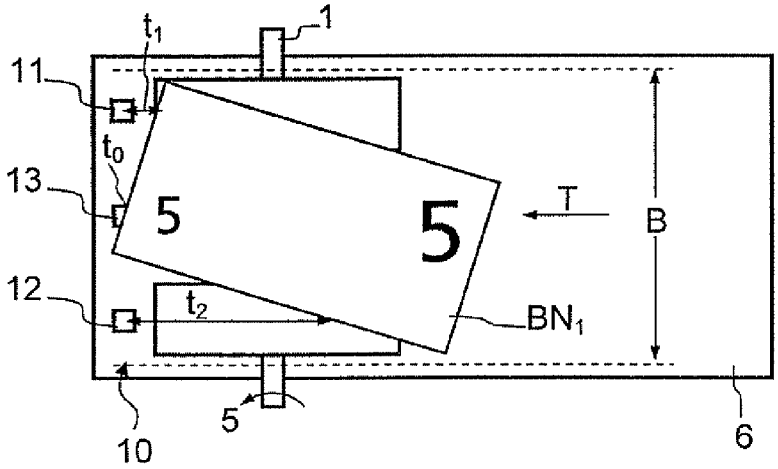

| Figure | state | LS 11 | US 13 | LS 12 | result |
|---|---|---|---|---|---|
| FIG. 4 | folded bank note central | no | double | no | error |
| FIG. 4 | folded bank note central, in single layer | no | single | no | error |
| FIG. 5 | folded bank note right | present | no | no | error |
| | folded bank note left | no | no | present | error |
| FIG. 6 | folded bank note left and right | present | no | present | error |
| FIG. 7 | more than one bank note | no or present | double | no or present | error |
| FIG. 8 | bank note left | no | single | present | correct |
| | bank note right | present | single | no | correct |
| | wide bank note | present | single | present | correct |
| FIG. 9 | bank note oblique | present, time $t_1$ | single, time $t_0$ | present, time $t_2$ | correct/ error |

The state represented in FIG. 4 shows a bank note $BN_1$, which is folded centrally along its long axis. The folded bank note $BN_1$ is transported in the center of width B of the transport system. At the point in time after the singling, ultrasonic sensor 13 determines the presence of the folded bank note, i.e. of more than one bank note, so that a signal is generated, according to which a double pick is present. Light barriers 11 and 12 are not interrupted, so that they generate a signal, according to which there is no bank note. By logically connecting the signals of the sensors, control unit 8 generates the result, according to which a faulty singling has taken place. This results from the fact that a double pick has been recognized. Additionally, because of the folding the singled bank note is too narrow, i.e. it has a width, which is smaller than the width of the smallest permissible bank note.

Analogous to the case described before with reference to FIG. 4, in which a bank note $BN_1$ is folded centrally along its long axis, a bank note torn along this line, i.e. a half bank note, could have been singled. At the point in time after the singling, ultrasonic sensor 13 determines the presence of the half, but only single-layer bank note, so that a signal is generated, according to which a single pick is present. Light barriers 11 and 12 are not interrupted, so that they generate a signal, according to which there is no bank note. By logically connecting the signals of the sensors, control unit 8 generates the result, according to which a faulty singling has taken place. Although the signal of ultrasonic sensor 13 indicates a single bank note, this bank note does not have the required minimum width.

In a further special case the bank note can be folded not exactly in the center of the bank note $BN_1$ along its long axis, so that the bank note $BN_1$ is single-layered along an area and is double-layered along the remainder. At the point in time after the singling, ultrasonic sensor 13 determines the presence of an either single-layer or double-layer bank note, so that a signal is generated, according to which a single pick or double pick is present. Light barriers 11 and 12 are not interrupted, so that they generate a signal, according to which there is no bank note. By logically connecting the signals of the sensors, control unit 8 generates the result, according to which a faulty singling has taken place.

The state represented in FIG. 5 shows a bank note $BN_1$, which is folded centrally along its long axis. The folded bank note BN.sub.$_1$, when viewed in transport direction T, is transported at the right edge of width B of the transport system. At the point in time after the singling, ultrasonic sensor 13 determines no bank note, so that a signal is generated, according to which there is no bank note. Light barrier 11 is interrupted, but not light barrier 12. Light barrier 12 thus generates a signal, according to which there is no bank note, whereas the signal of light barrier 11 indicates the presence of a bank note. By logically connecting the signals of the sensors, control unit 8 generates the result, according to which a faulty singling has taken place. Bank note $BN_1$. has not the required minimum width.

Analogously, a faulty singling will be determined, if the folded bank note $BN_1$, when viewed in transport direction T, is transported at the left edge of width B of the transport system.

The state represented in FIG. 6 shows two bank notes $BN_1$ and $BN_2$, which are folded centrally along their long axis. The folded bank notes $BN_1$ and $BN_2$, when viewed in transport direction T, are transported at the right and left edge of width B of the transport system. At the point in time after the singling, ultrasonic sensor 13 determines no bank note, so that a signal is generated, according to which there is no bank note. Light barriers 11 and 12 are interrupted, so that the two light barriers 11 and 12 generate signals, according to which there is a bank note. By logically connecting the signals of the sensors, control unit 8 generates the result, according to which a faulty singling has taken place. If it is a wide bank note, ultrasonic sensor 13 would also have generated a signal indicating the presence of a bank note.

The state represented in FIG. 7 shows two bank notes $BN_1$ and $BN_2$, which were jointly grasped and singled by singler 1, 2, 3, so that they overlap. For clarification, light barrier 12 and ultrasonic sensor 13 hidden by bank notes $BN_1$ and $BN_2$ are represented in dotted lines. Bank notes $BN_1$ and $BN_2$, when viewed in transport direction T, are transported at the left edge of width B of the transport system. At the point in time after the singling, ultrasonic sensor 13 determines two bank note, so that a signal is generated, according to which there is more than one bank note. Light barrier 11 is not interrupted, whereas light barrier 12 is interrupted. Accordingly, light barrier 11 generates a signal, according to which there is no bank note, and light barrier 12 generates a signal, according to which there is a bank note. By logically connecting the signals of the sensors, control unit 8 generates the result, according to which a faulty singling has taken place. Because a double pick was recognized.

Analogously, a faulty singling will be determined, when bank notes $BN_1$ and $BN_2$, when viewed in transport direction T, are transported at the right edge of width B of the transport system.

The state represented in FIG. 8 shows a bank note $BN_1$, which was grasped and singled by singler 1, 2, 3. Bank note $BN_1$, when viewed in transport direction T, is transported at the left edge of width B of the transport system. At the point in time after the singling, ultrasonic sensor 13 determines a bank note, so that a signal is generated, according to which there is a single bank note. Light barrier 11 is not interrupted, whereas light barrier 12 is interrupted. Accordingly, light barrier 11 generates a signal, according to which there is no bank note, and light barrier 12 generates a signal, according to which there is a bank note. By logically connecting the signals of the sensors, control unit 8 generates the result, according to which a correct singling has taken place, since a single bank note of sufficient width has been determined.

Analogously, a correct singling will be determined, when bank note $BN_1$, when viewed in transport direction T, is transported at the right edge of width B of the transport system. Then light barrier 11 generates a signal, according to which there is a bank note, whereas light barrier 12 generates a signal, according to which there is no bank note. Ultrasonic sensor 13 generates a signal, according to which there is a single bank note.

A correct singling is also determined, when bank note $BN_1$ takes up the entire width B of the transport system. Then light barriers 11 and 12 generate a signal, according to which there is a bank note. Ultrasonic sensor 13 generates a signal, according to which there is a single bank note.

The state represented in FIG. 9 shows a bank note $BN_1$, which was irregularly grasped by singler 1, 2, 3 and thus is transported in an oblique fashion. At the time t0 bank note $BN_1$ transported in an oblique fashion hides ultrasonic sensor 13, which then determines the presence of bank note $BN_1$ and generates a signal, according to which there is a single bank note. Light barriers 11 and 12 are interrupted, but only with a time shift. At the time $t_1$ light barrier 11 is interrupted, whereas light barrier 12 is interrupted at the time $t_2$. At the respective times $t_1$ and $t_2$ light barriers 11 and 12 thus generate signals, according to which there is a bank note. By logically connecting the signals of sensors 10 and evaluating the time differences between the times $t_0$, $t_1$ and $t_2$, control unit 8 generates the result, according to which a faulty singling has taken place. Likewise, it is possible that a correct singling has taken place. The decision between correct or faulty singling in this case depends on the time differences between the times $t_0$, $t_1$ and $t_2$. The maximum time differences permissible for a correct singling result from the geometric dimensions of the bank notes to be processed and thus from width B of the transport system, the distances between the sensors 11, 12 and 13 and the transport speed or singling speed.

The above-described logical connections of the signals of sensors 10 carried out by control device 8 were explained in FIGS. 4 to 9 with reference to the, in terms of its dimensions, smallest bank note to be processed. It is obvious that when larger bank notes are processed, different circumstances are given at sensors 10 in particular when bank notes are singled which are folded along their longitudinal axis. But in such cases the behavior is that of the state described in the table as "more than one bank note" on the basis of FIG. 7. Likewise, it is obvious that the bank notes, which in the described examples are transported in parallel to their long edges, can also be transported in parallel to their short edges. The dimensioning and arrangement of singler 1, 2, 3, sensors 10 and the transport system in this case are to be adjusted accordingly.

Sensors 10 are disposed, if possible, immediately after the singler 1, 2, 3, at a position at which the singling operation is completed. The distance between sensors 10 and singler 1, 2, 3 is advantageously chosen such that after the recognition of faulty singling operations there is sufficient time left to stop singler 1, 2, 3 such that faultily singled bank notes have not completely left the area of singler 1, 2, 3, i.e. the bank notes still partially protrude into the input area 6. The permissible distance between sensors 10 and singler 1, 2, 3, when viewed in transport direction T, substantially results from the speed of the transport system or singler 1, 2, 3 and the size of the smallest bank notes to be processed, when viewed in transport direction T.

When control device 8 determined a faulty singling operation, the control device 8 can introduce measures in order to prevent malfunctions in the processing of the bank notes.

For this purpose it can be provided that control device 8 stops motor 4. The bank notes faultily taken in then can be removed from the singler 1, 2, 3 by an operator.

Likewise, it is possible that control device 8 actuates motor 4 in such a way that motor 4 rotates singling element 1 for a certain time period in a second direction of rotation, which is opposite to the first direction of rotation 5, and then stops it. In this case the bank notes faultily taken in are moved out of singler 1, 2, 3 back into the input area 6 and can be removed from there by the operator.

Moreover, on a not shown display device of the bank note processing machine instructions generated by control device 8 can be displayed for the operator. If on the basis of the above-described monitoring the control device 8 concludes a faulty singling, an instruction can be displayed, which prompts the operator to remove the bank notes from the input area 6, to loosen them, so that e.g. bank notes sticking to each other are separated, and to again input the bank notes into the input area 6. Then the singling or processing of the bank notes can be re-started.

Sensors 11 and 12 have been described as individual light barriers so far. It is obvious that for each of the sensors 11 and 12 a plurality of light barriers can be used, which each can be disposed distributed over the section beginning at the edges of width B of the transport system and ending at the ultrasonic sensor 13. Instead of individual light barriers also linear arrays, so-called line arrays can be used. Instead of the ultrasonic sensor as sensor 13 there can be used any other sensor, which determines the thickness of the singled bank note, e.g. a mechanical or an optical thickness sensor.

The invention claimed is:

1. An apparatus for monitoring the singling of sheet material, comprising a singler, a drive and a control device arranged to monitor and control the singler;

a plurality of sensors adapted to monitor and output signals for place, time, orientation and state of the singled sheet material immediately after the singling;

wherein said plurality of sensors comprise three sensors which are disposed immediately after the singler, two of the sensors being disposed at opposite edge areas of the width provided for the transport of the sheet material and a third sensor being disposed between the two sensors, wherein signals of the plurality of sensors are evaluated by the control device with respect to the point of time of the presence or absence of sheet material at the plurality of sensors, and wherein the state of the singled sheet material is determined by the third sensor, wherein signals of the third sensor are evaluated by the control device with respect to the presence of one or a plurality of pieces of sheet material;

wherein the plurality of sensors are disposed substantially along a line extending perpendicular to a transport direction, which is located immediately after the singler, but at a maximum in a distance in which singled sheet material is still clamped by the singler;

wherein the control device is arranged to determine a correct singling of sheet material, if the signals of the third sensor and at least one of the two sensors disposed at opposite edge areas are present at the control device within a predetermined time difference, and if the signal of the third sensor for determining the presence of one or a plurality of pieces of the sheet material indicates the presence of a single piece of sheet material; and wherein the control device is arranged to determine a faulty singling of sheet material if the signals of the three sensors are not present at the control device within a predetermined time difference, or if the signal of the third sensor for determining the presence of one or a plurality of pieces of sheet material indicates the presence of a plurality of pieces of sheet material.

2. The apparatus according to claim 1, wherein the two sensors are disposed in opposite edge areas and comprise light barriers, and the third sensor comprises an ultrasonic sensor.

3. The apparatus according to claim 1, wherein the control device is arranged to stop the drive, and thus the singling of sheet material, after a faulty singling of sheet material has been determined.

4. The apparatus according to claim 3, wherein the control device is further arranged to reverse the direction of rotation of the drive and to cause the faulty singled sheet material to be transported back into an input area by the singler.

* * * * *